United States Patent [19]

Kikuchi et al.

[11] 4,449,813

[45] May 22, 1984

[54] COLLATING APPARATUS FOR COPYING MACHINE

[75] Inventors: Hideo Kikuchi; Sunao Ikeda; Yohtaro Kakitani; Kunio Hibi; Tugio Okuzawa, all of Tokyo, Japan

[73] Assignee: Ricoh Company, Ltd., Tokyo, Japan

[21] Appl. No.: 455,138

[22] Filed: Jan. 3, 1983

Related U.S. Application Data

[63] Continuation of Ser. No. 167,993, Jul. 14, 1980, abandoned.

[30] Foreign Application Priority Data

| | | | |
|---|---|---|---|
| Jul. 19, 1979 | [JP] | Japan | 54-90928 |
| Jul. 31, 1979 | [JP] | Japan | 54-97872 |
| Sep. 29, 1979 | [JP] | Japan | 54-126002 |

[51] Int. Cl.[3] ..... B65H 7/02; G03G 15/00

[52] U.S. Cl. ..... 355/14 R; 355/14 SH; 271/287; 271/259; 271/296

[58] Field of Search ..... 271/288, 289, 290, 259, 271/287, 296, 297; 270/258; 355/3 SH, 14 SH, 14 R

[56] References Cited

U.S. PATENT DOCUMENTS

| | | | |
|---|---|---|---|
| 3,709,485 | 1/1973 | Acquaviva | 271/259 |
| 3,774,906 | 11/1973 | Fagan et al. | 271/289 |
| 4,026,543 | 5/1977 | Leclere | 271/290 X |
| 4,229,100 | 10/1980 | Travis | 271/291 X |
| 4,285,508 | 8/1981 | Kaneko | 271/290 X |
| 4,344,614 | 8/1982 | Kaneko et al. | 271/288 |

*Primary Examiner*—Bruce H. Stoner, Jr.
*Assistant Examiner*—Lisa Rosenberg
*Attorney, Agent, or Firm*—David G. Alexander

[57] ABSTRACT

A deflector (C) is movable relative to bin (E) to selectively deflect sheets into the bins (E) for collation. An enable signal for a next collation operation is generated when a sensor (94) senses that the required number of sheets for collation have been discharged into the bins (E). The sensor (94) in combination with a sensor (45) which senses sheets entering the collator (2) detect a sheet jam and enable computation of the number of jammed sheets by subtracting the number of sheets discharged into the bins (E) from the number of sheets entering the collator (2).

7 Claims, 16 Drawing Figures

100
Vcc
R1
SW1
GND
IN1
S1
101
F/F
102
S2
IN2
IN3
CLUTCH CONTROL
131
135
CLUTCH CONTROL
137
S3
CLUTCH CONTROL
108
107
DELAY
S3
TIMER
106
S1
SENSOR
43
SENSOR
41
SENSOR
42
SHAPER
103
104
S F/F R
105
SOLENOID CONTROL
139

COLLATING APPARATUS FOR COPYING MACHINE

CROSS REFERENCE TO RELATED APPLICATION

This application is a continuation of copending U.S patent application Ser. No. 167,993, filed July 14, 1980 , now abandoned.

BACKGROUND OF THE INVENTION

The present invention relates to a copying machine equipped with a document collating device (collator) with or without an automatic document feeding or handling device ADH (auto document handler).

Generally, a collator has a plurality of sheet storing bins arranged one upon another and operates in a collation mode to distribute a set of copy sheets one by one into individual bins. The collator is also operable in a sorting or assortment mode in which copy sheets are fed or delivered successively into a single bin until a predetermined number is reached and then copy sheets are fed in the same way to the next bin.

A conventional copying machine with a collator usually has such a design that, after the completion of exposure, the copying operation for the next document page can be started. This inherent design brings about the following problem where there is a relatively long copy conveyance path including the copying machine body and collator, and sheets become jammed in such a conveyance path.

To make the description simple, suppose that an intended number of copies N is "9", that the 8th and 9th copies of the 5th page are travelling in the conveyance path in the collator, and that the 1st, 2nd and 3rd copies of the 6th page are moving simultaneously in the copying machine body.

When jamming occurs in the collator, the conveyance drive in thc collator will he interrupted to allow only the three copy sheets or copies in the copying machine body to be discharged into a temporary discharge tray. The copy sheets in the collator on the other hand are wasted as jammed sheets. This is because it is quite difficult to exactly determine how many copies will be actually lost or to correlate the wasted copies with proper original documents. Thus, the 8th and 9th copies of the 5th page of the document are handled as jammed sheets. Accordingly, if manual insertion means or a feeder section is used in the above situation to cause the collator to collate the copies in the temporary discharge tray or the copying machine is energized, copies will be fed to the 8th and 9th bins of the collator in the wrong order, that is, the order of pages will be disrupted. This is because the copies in the temporary discharge tray or those fed from the copying machine body are not of the 5th page but of the 6th page.

In such a case, it is very troublesome to determine whether the jammed copies belong to the 5th page or the 6th page and the discrimination may become practically impossible depending on the construction of the collator. Furthermore, the operator must undertake quite intricate manipulation for re-loading the 5th document to re-copy it and then loading the 6th document to re-copy it.

Meanwhile, in a copying machine with an ADH, the ADH feeds documents one by one from a document tray to a copying position and, in this position, one copy or a series of copies are made. Thereafter, the document in the copying position is automatically returned to the tray while the next document if present is transferred to the copying position on a glass platen to undergo the same procedure.

A copy machine of the conventional design is operated for a high-speed continuous process such that a document on the glass platen is fed back to the document tray before the last copy thereof is delivered to a bin of the collator and the next document is fed to the glass platen. Accordingly, by the time jamming occurs in the collator during collation of the copies of the 1st page for example, the ADH will have already replaced the lst document with the second despite the fact that the actual number of copies of the 1st page is short by the number of wasted copies, that is, the 1st document or page needs be re-copied to compensate for the shortage. This has heretofore been coped with by replacing the 2nd document with the 1st document.

It will thus be seen that the system which automatically returns a document by ADH in the event of jamming may damage valuable documents and renders the mechanism of the document handler disproportionately complex.

SUMMARY OF THE INVENTION

A collating apparatus embodying the present invention includes a plurality of bins, deflector means for deflecting sheets into selected bins, feed means for feeding the sheets to the deflector means and discharge sensor means for sensing discharge of sheets from the deflector means into the bins, and is characterized by comprising sheet number storage means for storing a number representing the quantity of sheets to be collated, discharge counter means for counting a number of sheets discharged into the bins, comparator means for comparing the number of sheets discharged into the bins with the number of sheets to be collated and producing a next collating operation enable signal when said numbers are equal, and inlet sensor means for sensing entry of sheets into the feed means, inlet counter means for counting a number of sheets which entered the feed means, jam sensor means for sensing a sheet jam and producing a jam signal in response thereto and computing means for computing a number of jammed sheets by subtracting the number of sheets discharged into the bins from the number of sheets which entered the feed means in response to the jam signal, and a copying machine for copying a document and feeding the sheets in the form of copies of the document to the feed means, the copying machine comprising copy counter means for counting a number of copies produced, the apparatus further comprising means for directly transferring a count in the discharge counter means which represents the number of sheets discharged into the bins into the copy counter means to constitute a new count ir the copy counter means in response to the jam signal.

In accordance with the present invention, a deflector is movable relative to bins to selectively deflect sheets into the bins for collation. An enable signal for a next collation operation is generated when a sensor senses that the required number of sheets for collation have been discharged into the bins. This sensor in combination with a sensor which senses sheets entering the collator detect a sheet jam and enable computation of the number of jammed sheets by subtracting the number of sheets discharged into the bins from the number of sheets entering the collator.

It is an object of the present invention to provide a collating apparatus for an electrostatic copying machine or the like which enables automatic sheet jam detection and handling.

It is another object of the present invention to provide a collating apparatus which greatly speeds up and facilitates the handling of sheet jams.

It is another object of the present invention to provide a generally improved collating apparatus.

Other objects, together with the foregoing, are attained in the embodiments described in the following description and illustrated in the accompanying drawing.

BRIEF DESCRIPTION OF THE DRAWING

FIGS. 8A and 8B in combination constitute a block diagram of circuitry for controlling the ADH and collator;

FIG. 10 is a diagram showing how

FIGS. 10A and 10B in combination constitute a diagram showing details of a part of the collator control circuit;

DESCRIPTION OF THE PREFERRED EMBODIMENTS

While the collating apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
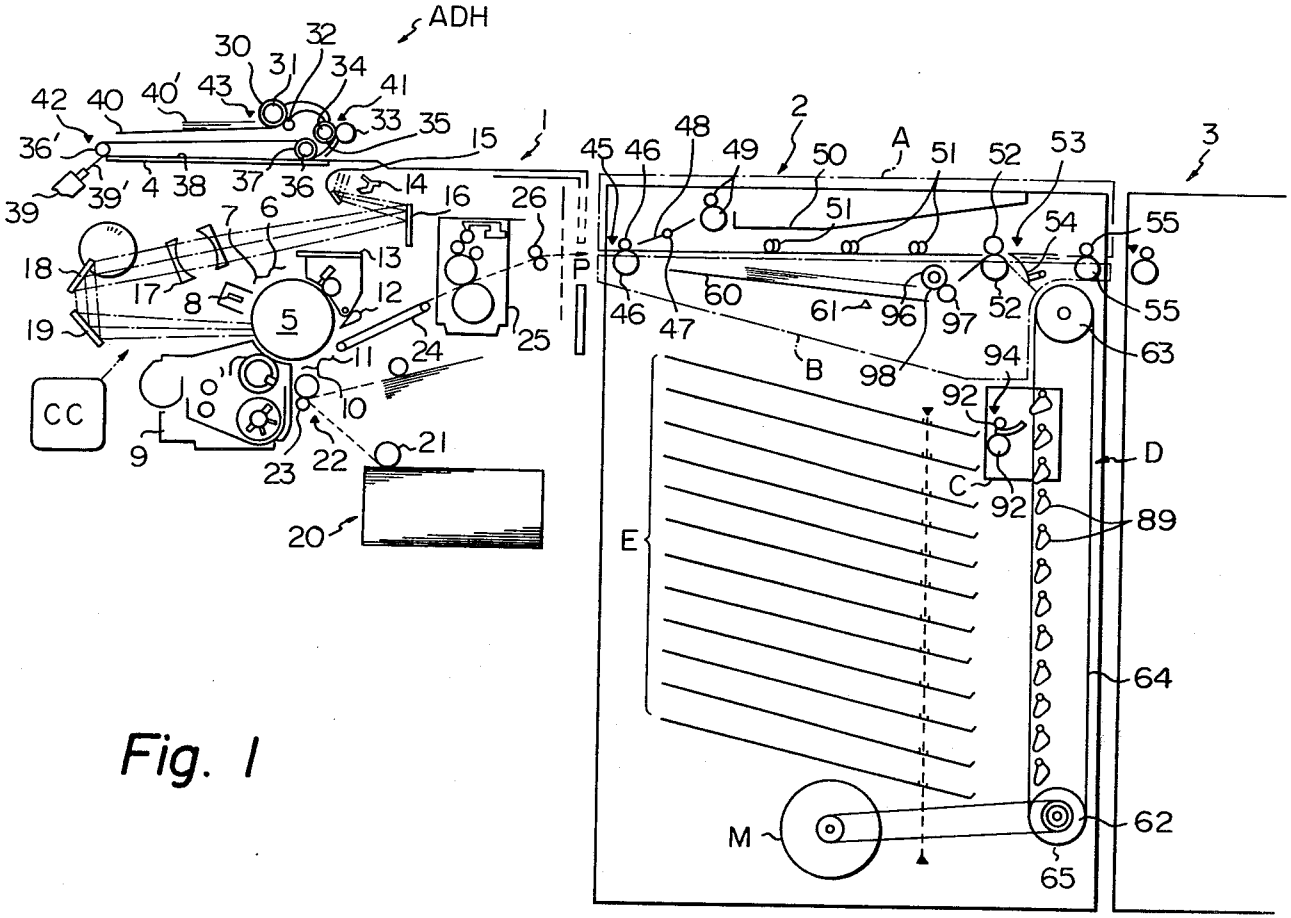
FIG. 1 schematically shows a copying machine according to the present invention which is equipped with an automatic document handling device ADH and collators.

Referring to FIG. 1, there are shown a copying machine 1, first and second collators 2 and 3 adjacent to the copying machine 1, and an automatic document handing device ADH disposed above a glass platen 4 of the copying machine.

The copying machine 1 includes a photosensitive drum 5 around which are disposed a charge expelling or discharging charger 6, a main charger 7, a charge removing lamp 8, a developing unit 9, a transfer charger 10, a separating charger 11, a separating pawl 12 and a cleaning unit 13. The reference numeral 14 denotes a halogen lamp serving as part of a scanner of a slit exposure device. In operation, the drum 5 is first deposited with a uniform surface charge by the charger 7. The halogen lamp 14 moves to illuminate a document on the glass platen 4 and light reflected from the document is re-reflected by first and second mirrors 15 and 16 and transmitted through a converging lens 17 to slit-expose the drum surface. An area of the drum 5 now carrying a latent image is processed by the developing unit 9 and has the latent image developed into a visible toner image. Meanwhile, a transfer sheet is fed from a sheet feed station 20 by a lower feed roller 21 to a pair of registration rollers 23. This sheet in the stand-by at the roller pair 23 is advanced therefrom at a suitable timing to register with the toner image on the drum 5. Then the transfer charger 10 transfers the toner image onto the sheet whereupon the charger 11 and pawl 12 for separation remove the sheet from the drum surface. The sheet now clear of the drum 5 is transferred by a conveyor belt 24 to a fixing unit 25. The sheet having the toner image fixed thereon advances through a pair of discharge rollers 26 to the outside of the machine housing and enters the first collator 2 next to the copying machine 1. The surface of the drum 5 is cleaned by the cleaning unit 13 to get ready for another copying cycle.

In the sheet feed station, a sheet sensor 22 is located in a position adjacent to the sheet inlet side of the roller pair 23 so as to monitor the feeding of sheets.

The automatic document handling device ADH includes a conveyor belt 38 adapted to convey a document and is passed over a drive roller 36 neighboring the home position of the scanner and a driven roller 36' located on the other side of the glass platen 4. An electromagnetic clutch 37 is operably associated with the drive roller 36 in order to selectively drive the drive roller 36 and, therefore, the conveyor belt 38.

Disposed above the conveyor belt 38 is a document tray 40 loaded with a stack of documents 40'. The documents 40' are fed one by one from the tray 40 by a feed roller 30 and a stationary separating roller 32 which oppose each other. An electromagnetic clutch 31 is operably associated with the roller 30 to control the feed of the documents 40'. A document 40' fed from the tray 40 is temporarily stopped by a pair of registration rollers 33 and 34 positioned in a passage 44 which extends from the roller 30 to the inlet of the conveyor belt 38. The document 40' in the stand-by position re-starts its movement to the conveyor belt 38 along the passage 44 when an electromagnetic clutch 35 is coupled to drive the associated registration roller 34 for rotation. Then the conveyor belt 38 controlled by the clutch 37 causes the document 40' to advance between the belt 38 and glass platen 4 until a stop pawl 39' at the left end of the glass platen 4 is engaged by the document 40'. The document 40' thus abuts against the stop pawl 39' and stops. To replace the document 40' on the glass platen 40 with another, the stop pawl 39' will be retracted by a stop pawl drive solenoid 39 allowing the document 40' on the glass platen 4 to return to the tray 40. Denoted by the reference numeral 41 is a sheet sensor (document sensor) located at the registration roller portion, 42 a document discharge sensor, and 43 a document sensor located above the tray 40.

The first collator 2 is shown to comprise a sheet aligning section A, a feeder section B disposed below the sheet aligning section A, a vertically movable deflecting device C adapted to direct copies to selected bins, a conveyor section D supporting the deflector C and conveying copy sheets from the section A or B to the deflector C, an array of bins E, and a motor M.

Figure 2:
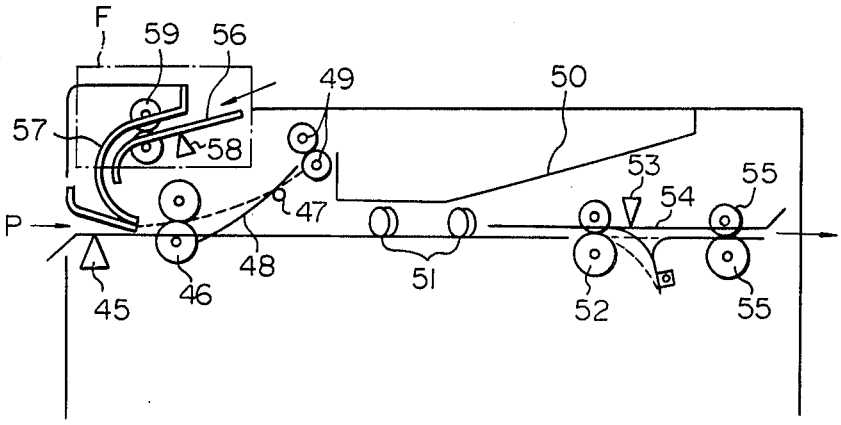
FIG. 2 is a fragmentary view of a collator showing its sheet aligning section.

Referring to FIGS. 1 and 2, a copy sheet or copy discharged from the copying machine 1 enters the first collator 2 as indicated by an arrow P and, while being monitored by a sheet sensor 45, is caught by a pair of inlet rollers 46. These rollers 46 advance the copy sheet to a guide plate 48 whose position is controlled by a solenoid 47. Depending on its position, the guide plate 48 directs the copy sheet either to a temporary discharge tray 50 or horizontally to skew rollers 51 for collation or assortment.

The skew rollers 51 bias the copy sheet toward a reference plate (not shown) so as to provide the copy sheet with a given position and a given orientation. A pair of intermediate rollers 52 feed the copy sheet further to a path selector plate 54 having a first position indicated by a solid line in the drawings and a second position indicated by a phantom line. When the path selector plate 54 is in the solid line position, it will deliver the copy sheet to the conveyor section D; in the phantom line position, it will direct the copy sheet to the second collator 3 by way of a pair of outlet rollers 55. A sheet sensor 53 is located in a position downstream of the intermediate roller pair 52 with respect to the direction of travel of the copy sheet. In the event jamming or failure occurs in the section past the skew rollers 51, rotation of all the rollers will be stopped except for the inlet roller pair 46 and outlet roller pair 49 and the guide plate 48 will assume the solid line position to move all the copies entering the first collator 2 into the temporary discharge tray 50.

A section F indicated by a dot-and-dash line in FIG. 2 is for manual insertion of sheets. A sheet is inserted manually between guide plates 56 and 57 until it is detected by a sheet sensor 58. Then, if the mechanism is capable of accomodating manual insertion, a clutch (not shown) in the section F will drive a pair of rollers 59 for rotation. When the sheet is further advanced as far as the roller pair 59, it will be advanced thereby to the inlet roller pair 46.

The feeder section B and sheet aligning section A are hinged to each other at the right side and the sheet aligning section A is liftable from the right side. This makes it easy to remove jammed sheets in the conveyance path and to load a sheet feed table 60 with a stack of copy sheets. A sheet sensor 61 is associated with the sheet feed table 60 to determine whether the latter contains sheets.

The conveyor section D comprises a conveyor belt 64 passed over a drive roller 62 and a driven roller 63. The motor M drives the drive roller 62 through an electromagnetic clutch 65.

Figure 3:
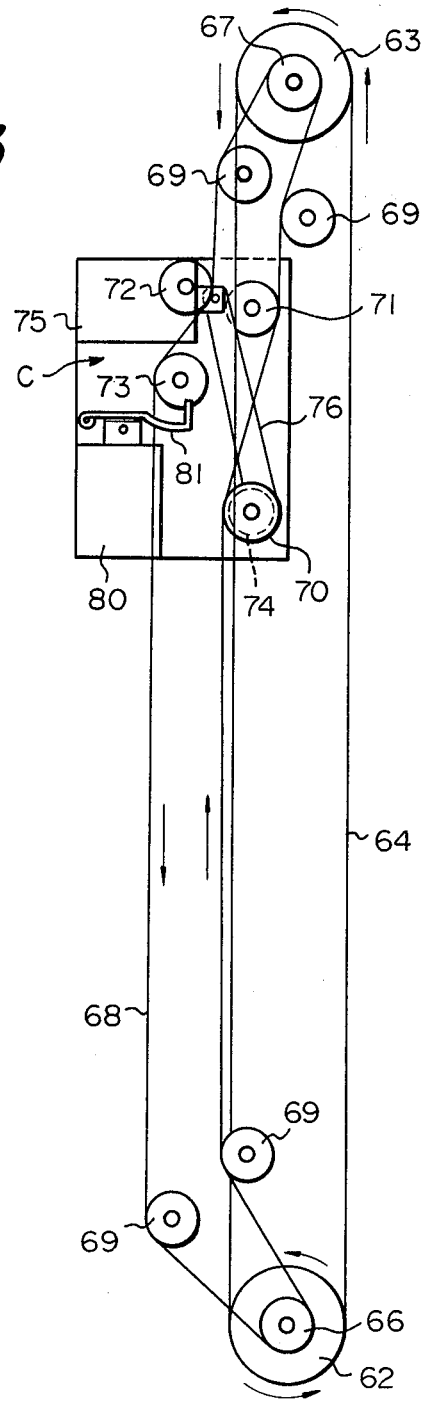
FIG. 3 is a schematic elevation illustrative of cooperation of a conveyor section and a deflector of the collator.

As shown in FIG. 3, the conveyor belt 64 runs over the drive and driven rollers 62 and 63 while a first chain 68 is passed over a sprocket 66 rigid on the shaft of the drive roller 62 and a sprocket 67 freely rotatable on the shaft of the driven roller 63. It will be seen that, since the diameter of the sprocket 66 is smaller than that of the drive roller 62, the chain 68 rotates at a velocity lower than the velocity of the conveyor belt 64. The chain 68 is also passed over sprockets 69 included in the conveyor section D and sprockets 70, 71, 72 and 73 in the deflector C.

The deflector C will be raised when the chain 68 rotates clockwise in FIG. 3 and vice-versa. For this purpose, a spring clutch 74 is associated with the sprocket 70 and mounted on a stationary shaft of the deflector C. The spring clutch 74 is operated by an elevation solenoid 75 through a lever 76. When the solenoid 75 is energized, the clutch 74 will be uncoupled to render the sprocket 70 free and thereby cause only the chain 68 to rotate with the deflector C kept stationary. When the solenoid 75 is de-energized, the lever 76 will spring back to the original position and the sprocket 70 will be locked to the stationary shaft through the clutch 74. This allows the chain 68 to move with the sprocket 70 and, therefore, the deflector C during its upward travel. When the deflector C reaches the uppermost position where it is to stop, it actuates a home position switch 85 (FIG. 6) which in turn energizes the solenoid 75. Then the clutch 74 is uncoupled, the deflector C thus disconnected from the chain 68 stops its upward movement.

Figure 4:
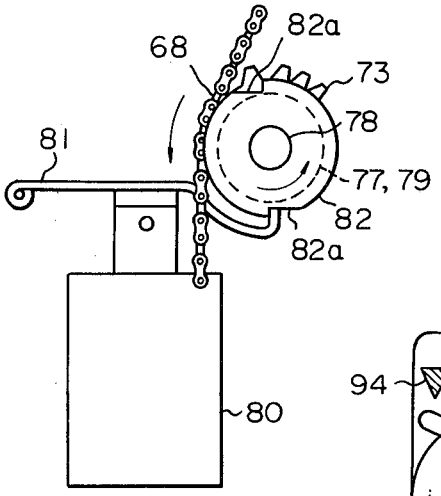
FIG. 4 shows a clutch control mechanism for lowering the deflector.
Figure 5:
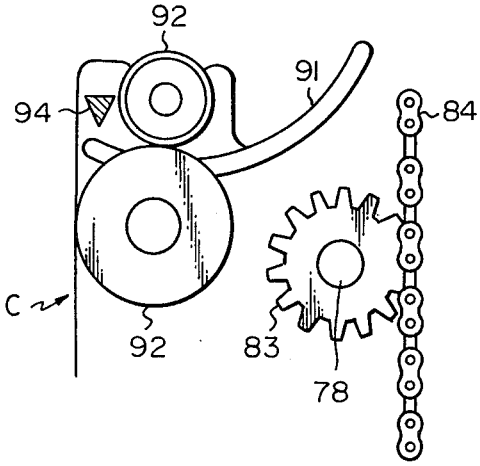
FIG. 5 illustrates stepwise feed of the deflector.

Concerning the downward movement of the deflector C, it is essentially the same as the upward movement discussed above except that it must be precisely by an incremental amount. As shown in FIG. 4, this is achieved by the provision of the sprocket 73 meshed with the chain 68, a spring clutch 77 associated with the sprocket 73, an electromagnetic clutch 79 intervening between the spring clutch 77 and a shaft 78, a solenoid 80 adapted to couple and uncouple the spring clutch 77 for lowering the deflector C, a lever 81 connected with the plunger of the solenoid 80, and a cam sleeve 82 having diametrically opposite slots **82*a* engagable with one end of the lever 81 and functioning to control coupling and uncoupling of the spring clutch 77. As seen in FIG. 5, the shaft 78 also rigidly carries therewith a sprocket 83 which is secured to the conveyor section D and, thus, meshes with a stationary second chain 84**.

When the solenoid 80 is de-energized, the actuating end of the lever 81 is engaged in one slot **82*a* of the cam sleeve 82 to uncouple the spring clutch 77 so that, though the chain 68 may rotate the sprocket 73, the shaft 78 remains stationary keeping the deflector C stationary. Upon energization of the solenoid 80, the actuating end of the lever 81 is disengaged from the slot 82*a* to couple the spring clutch 77. Then the rotation of the sprocket 73 driven by the chain 68 is transmitted to the shaft 78 by the electromagnetic clutch 79 which is usually kept coupled, causing the sprocket 83 to rotate together with the shaft 78. Consequently, the sprocket 83 rolls down along the stationary second chain 84 allowing downward movement of the deflector C. Immediately after the lever 81 has been disengaged from the slot 82*a*, the solenoid 80 is again de-energized so that the actuating end of the lever 81 slides along the periphery of the cam sleeve 82 in engagement therewith. After a half turn, the lever 81 engages the second diametrically opposite slot 82*a* on the cam sleeve 82 whereby the rotation of the cam sleeve 82 is interrupted. The spring clutch 77 is again uncoupled stopping the downward movement of the deflector C through the shaft 78 and sprocket 83. In this way, the deflector C is indexed downward a distance precisely corresponding to the half turn of the cam sleeve 82** and this distance is equal to the distance between neighboring bins.

Figure 6:
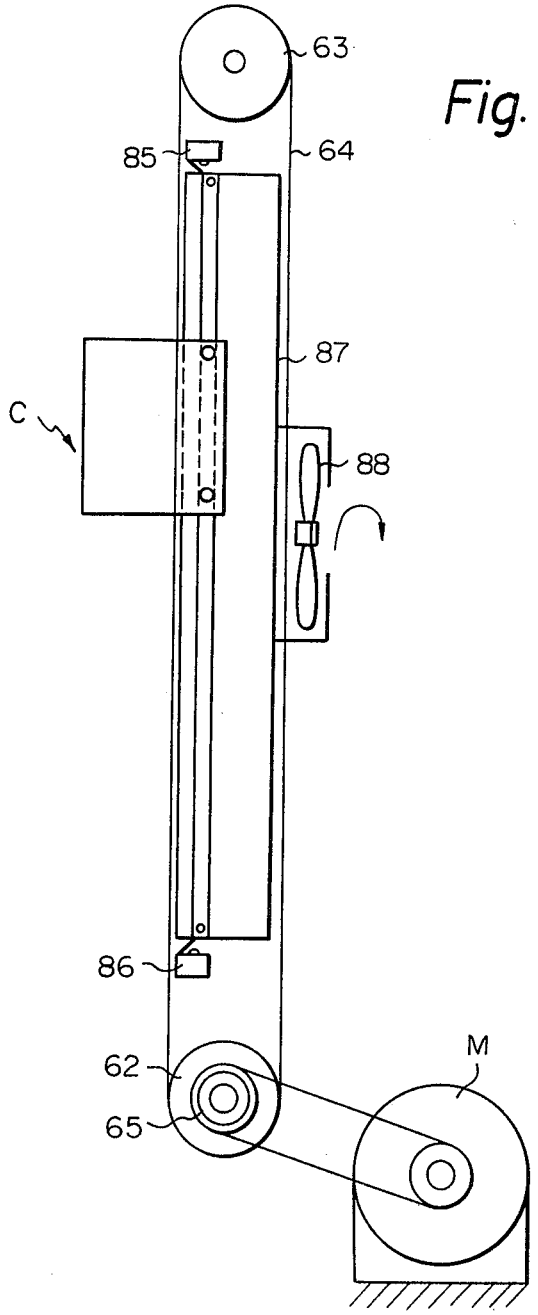
FIG. 6 shows the conveyor section.

Turning to FIG. 6, the opposite vertical runs of the conveyor belt 64 which pass over the rollers 62 and 63 have a vacuum chamber 87 therebetween. A blower 88 constantly supplies the vacuum chamber 87 with vacuum. A wall portion of the vacuum chamber 87 which confronts the array of bins and is engaged by the conveyor belt 64 is formed with rows of suction holes, and the conveyor belt 64 is also formed with like apertures. The reference numeral 86 denotes and end detection switch responsive to the downward movement of the deflector C. When a copy sheet arrives at the conveyor section at the time the apertures of the conveyor belt 64 have aligned with those of the vacuum chamber wall, it is sucked onto the conveyor belt 64 and carried thereby to the deflector C. A deflecting cam 89 shown in FIG. 7 deflects the copy sheet into a selected bin.

Figure 7:
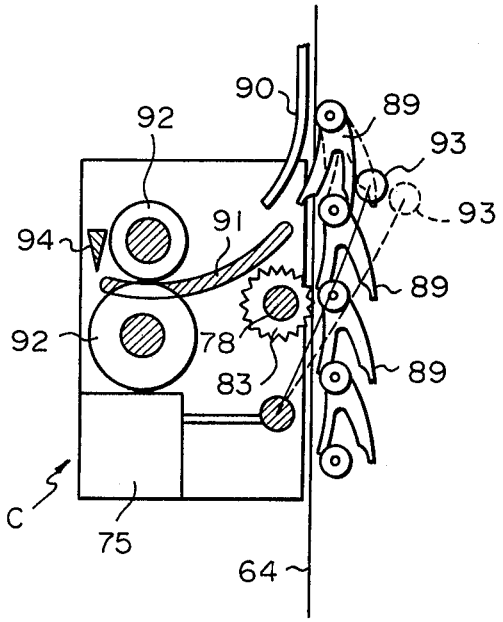
FIG. 7 is explanatory of cooperation of the deflector and deflecting cam.

As shown in FIG. 7, a plurality of deflecting cams 89 are disposed in correspondence with individual bins in the first collator 2. Let it now be assumed that the deflector C has stopped in a position corresponding to an intended bin. In this situation, one of the deflecting cams 89 corresponding to the selected bin remains projected from the conveyor belt 64 so that a copy sheet fed by the conveyor belt 64 to the deflector C is separated from the conveyor belt 64 by the curved guide surface of the deflecting cam 89. Then the copy sheet advanced between guide plates 90 and 91 supported by the deflector C and is discharged by a discharge roller pair 92 into the selected bin.

The position of the deflecting cam 89 projected beyond the conveyor belt 64 is established when a cam drive lever 93 of the deflector C is locked in the solid line position. This lever 93 remains in the solid line position during downward movement of the deflector so as to cause a selected deflector cam 89 to project as mentioned above while, during upward movement of the deflector C, shifting to the phantom line position where it becomes clear of the deflector cams 89. The aforementioned solenoid 75 controls the actions of the lever 93. When the solenoid 75 is de-energized, the deflector C will be elevated with the lever 93 held in the phantom line position shown in FIG. 7. With the solenoid 75 energized, the lever 93 will assume the solid line position and the deflector C will be in a position awaiting energization of the solenoid 80. The reference numeral 94 designates a sheet sensor disposed in the deflector C.

Figures 8, 8A, 8B:
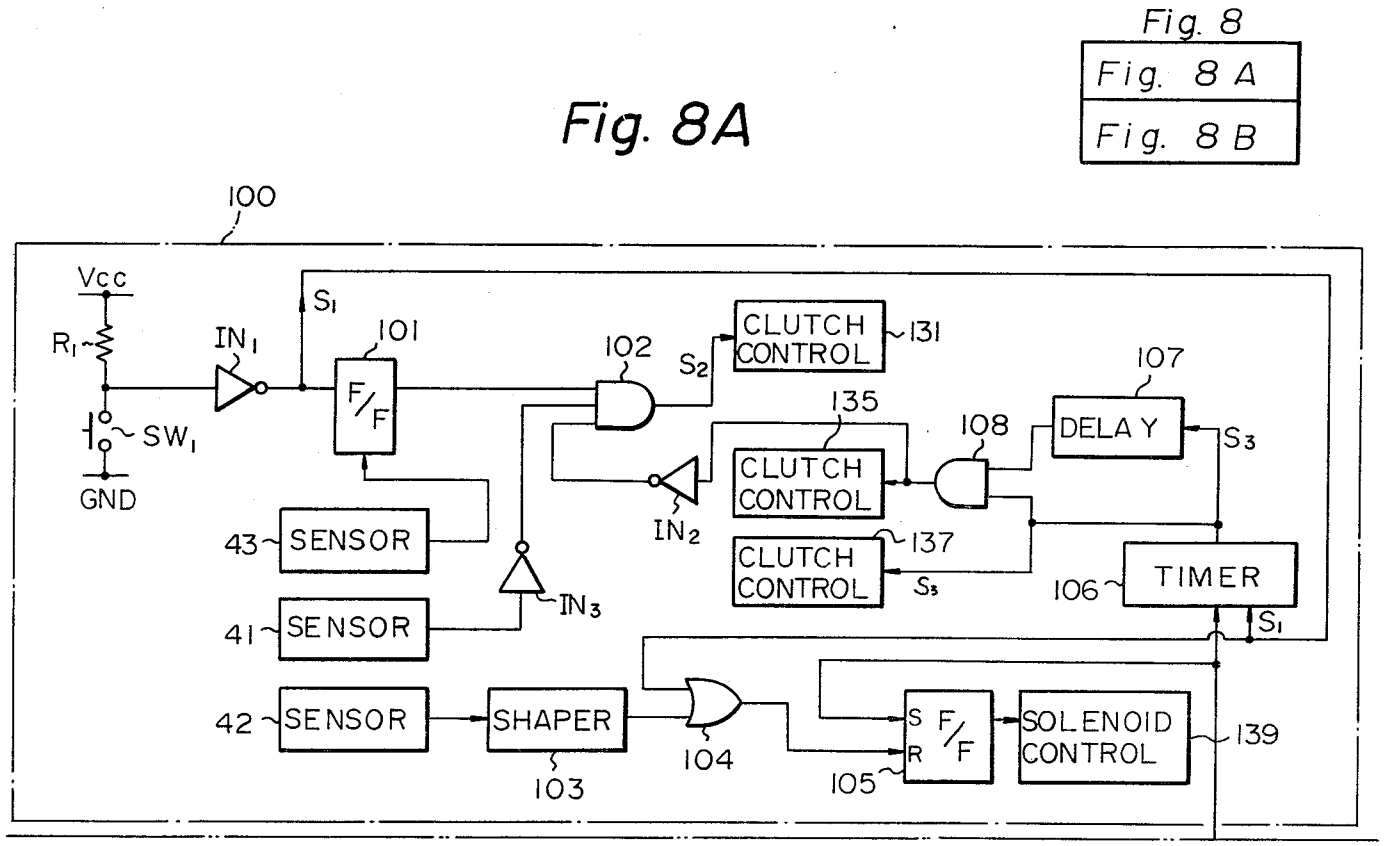
FIG. 8 is a diagram showing how
FIGS. 8A and 8B are combined to constitute a block diagram of circuitry for controlling the ADH collator.
Figure 8B:
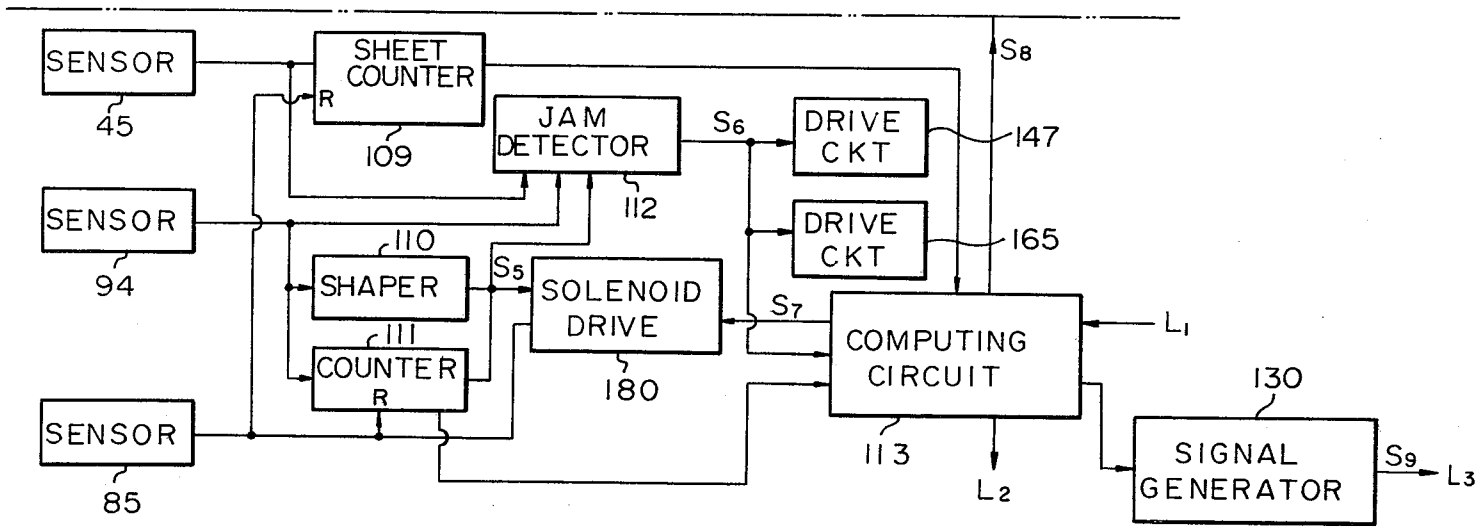

FIGS. 8A and 8B in combination constitute a circuit diagram for the control of the automatic document handling device ADH and collator; a portion enclosed by a dot-and-dash line indicates an ADH control.

The ADH control designated by the numeral 100 includes an ADH selector switch SWI, a clutch control circuit 131 associated with the electromagnetic clutch 31, a clutch control circuit 135 associated with the electromagnetic clutch 35, a clutch control circuit 137 associated with the electromagnetic clutch 37, and a solenoid control circuit 139 associated with the solenoid 39.

In the event the document sensor 43 detects documents 40' loaded in the device ADH, and when the ADH selector switch SWI is closed, and ADH selection signal $S_1$ is supplied from an inverter $IN_1$ connected with the switch SWI to set a flip-flop 101. The output of the flip-flop 101 is coupled to a first input terminal of a 3-input AND gate 102. A second input terminal of the AND gate 102 is connected to the document sensor 41 by way of an inverter $IN_3$. In an initial stage, a document will not have arrived at the registration roller pair 33, 34 of the device ADH. Under this condition, the output of the inverter $IN_3$ which is the second input of the AND gate 102 is "1". A third input terminal of the AND gate 102 is connected with the output terminal of an AND gate 108 through an inverter $IN_2$. Since the output of the AND gate 108 is "0" as will be discussed below and a registration roller drive signal $S_4$ is absent, the output of the inverter $IN_2$ which is the third input of the AND gate 102 is "1". Therefore, the AND gate 102 supplies the clutch control 131 with a feed roller drive signal $S_2$ simultaneously with closing of the switch SWI. Then the electromagnetic clutch 31 is coupled to drive the feed roller 30 of the device ADH whereby a document on top of the stack 40' is fed by the feed roller 30 cooperating with the stationary separator roller 32.

When the document advances to the registration roller pair 33, 34 and reaches the position of the document sensor 41, the sensor 41 detects the presence of the document. Then the output of the inverter $IN_3$ becomes "0" and the signal output $S_2$ of the AND gate 102 disappears to stop any further movement of the document. As a result, the document stays at the position of the roller pair 33, 34 to await the start of rotation of the register roller pair 33, 34.

Meanwhile, the ADH selection signal $S_1$ is also coupled to a conveyance time generating circuit or timer 106 adapted to generate a time period $T_0$ which the document is to take to be fed by the belt 38 over the glass platen 4 until it abuts against the stop pawl 39' after being driven by the registration roller pair 33, 34. The output of this circuit 106 (conveyance time signal $S_3$) is coupled to the control circuit 137 associated with the electromagnetic clutch 37, a second input terminal of an AND gate 108 and a delay circuit 107.

The control circuit 137 delivers a signal when receiving the conveyance time signal $S_3$ coupling the electromagnetic clutch 37. This drives the drive roller 36 for rotation and thereby causes the associated conveyor belt 38 to start rotation. The stop pawl 39' has protruded since a flip-flop 105 ahead of the solenoid control 139 has been reset by the ADH selection signal $S_1$ through an OR gate 104.

After the start of rotation of the belt 38, the AND gate 108 receives the signal $S_3$ at its first input terminal through the delay circuit 107. The AND gate 108 then couples a registration roller drive signal $S_4$ to the clutch control 135 and inverter $IN_2$. The clutch control 135 produces a signal for coupling the electromagnetic clutch 35 whereupon the registration roller pair 33, 34 starts to rotate. Thus, the document in the stand-by position at the roller pair 33, 34, is advanced and tranferred to the conveyor belt 38 through the passage 44. The conveyor belt 38 moves the document toward the stop pawl 39' along the glass platen 4.

At the time the document thus fed by the conveyor belt 38 arrives at the stop pawl 39', the circuit 106 interrupts its signal output. Upon disappearance of the signal $S_3$, the electromagnetic clutch 37 associated with the drive roller 36 is uncoupled to stop the rotation of the drive roller 36 whereby the document stops its movement on the glass platen 4 in a position having its leading end abutted against the stop pawl 39'. The rotation of the registration roller pair 33, 34 also stops bacause the drive signal $S_4$ disappears when the signal $S_3$ disappears.

The document thus loaded on the platen 4 is automatically replaced by the next document when a replacement signal $S_8$ is coupled to the above-mentioned circuitry from a collator control section which is shown in FIGS. 8A and 8B but not enclosed by a dot-and-dash line. This signal $S_8$ will appear when it is confirmed that the last copy of a document has been fed into a bin E of the collator 2.

The collator control section in FIGS. 8A and 8B includes a drive dircuit 147 for driving the solenoid 47 associated with inlet guide plate 48, a drive circuit 165 associated with the electromagnetic clutch 65 for the conveyor belt 64, and a circuit 180 adapted to control the elevation solenoid 75 and lowering solenoid 80 associated with the deflector C. A sheet counter 109 counts the number of sheets detected by the inlet sheet sensor 45. A shaper circuit 110 processes the output of the sheet sensor 94 in the deflector section and a slightly delayed and inverted version of the same sensor output to provide a tail-of-sheet signal $S_5$ in the form of a pulse. A counter 111 counts on the basis of the tail-of-sheet signal $S_5$ the number of copies delivered from the deflector C into the bins E. A jam detection circuit 112 serves as a timer circuit which provides a first time period $T_1+\delta$ from the instant a sheet is to be detected by the sheet sensor 45 to the instant it is to be detected by the sheet sensor 94, and a second time period $T_2+\delta$ from the instant the sheet sensor 94 is to detect a sheet to the instant the detected sheet is to move fully past the sensor 94. This circuit 112 will produce a jam detection signal $S_6$ when it is not reset even after the lapse of either of the two time periods mentioned above. A comparing and computing circuit 113 delivers a deflector elevation signal $S_7$ and a document replacement signal $S_8$ when the count of the sheet discharge counter 111 becomes coincident with the number of N of copies to be collated which is set in advance through information line $L_1$ from the copying machine. Also, the comparator/computer 113 responds to a jam detection signal $S_6$ to subtract the content of the sheet discharge counter 111 from that of the sheet reception counter 109 and supplies the copying machine with information through line $L_2$ indicative of the number n of sheets which will be wasted by jamming (jammed number of sheets). Here, the number n of jammed sheets means the number of sheets existing in the path from the inlet sheet sensor 45 to the discharge rollers 92 of the deflector C.

When the copying machine 1 starts its operation and completes a cyclic copying process to feed a copy sheet from the discharge rollers 26, the inlet roller pair 46 catches this copy sheet. Detecting the copy sheet, the sheet sensor 45 delivers its output to the counter 109 and jam detector circuit 112. The counter 109 counts up "1" when the head or leading end of a sheet is detected and the tail or trailing end of the same is also detected. The jam detector circuit 112 starts timing $T_1+\delta$ which the sheet takes to travel to the sheet sensor 94 in the deflector section.

The copy sheet reaches the conveyor belt 64 by way of the rollers 51, and intermediate rollers 52 in succession. The copy sheet conveyed by the belt 64 is separated from the belt surface by the curvature of a selected deflecting cam 89 and then discharged by the roller pair 92 into a selected bin E corresponding to the cam 89. The sheet sensor 94 detects this copy sheet and couples an output signal to the tail-of-sheet detector circuit or shaper 110, sheet discharge counter 111 and jam detector circuit 112. The jam detector circuit 112 for the sheet conveyance time $T_1+\delta$ is reset by the output of the sheet sensor 94 indicative of the leading end of the sheet, thus producing no jam detection signal $S_6$.

Figure 10A:
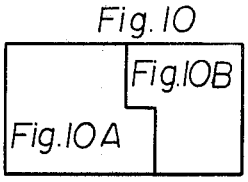
FIGS. 10A and 10B are combined to constitute a diagram showing details of a part of the collator control circuit.
Figure 10A:
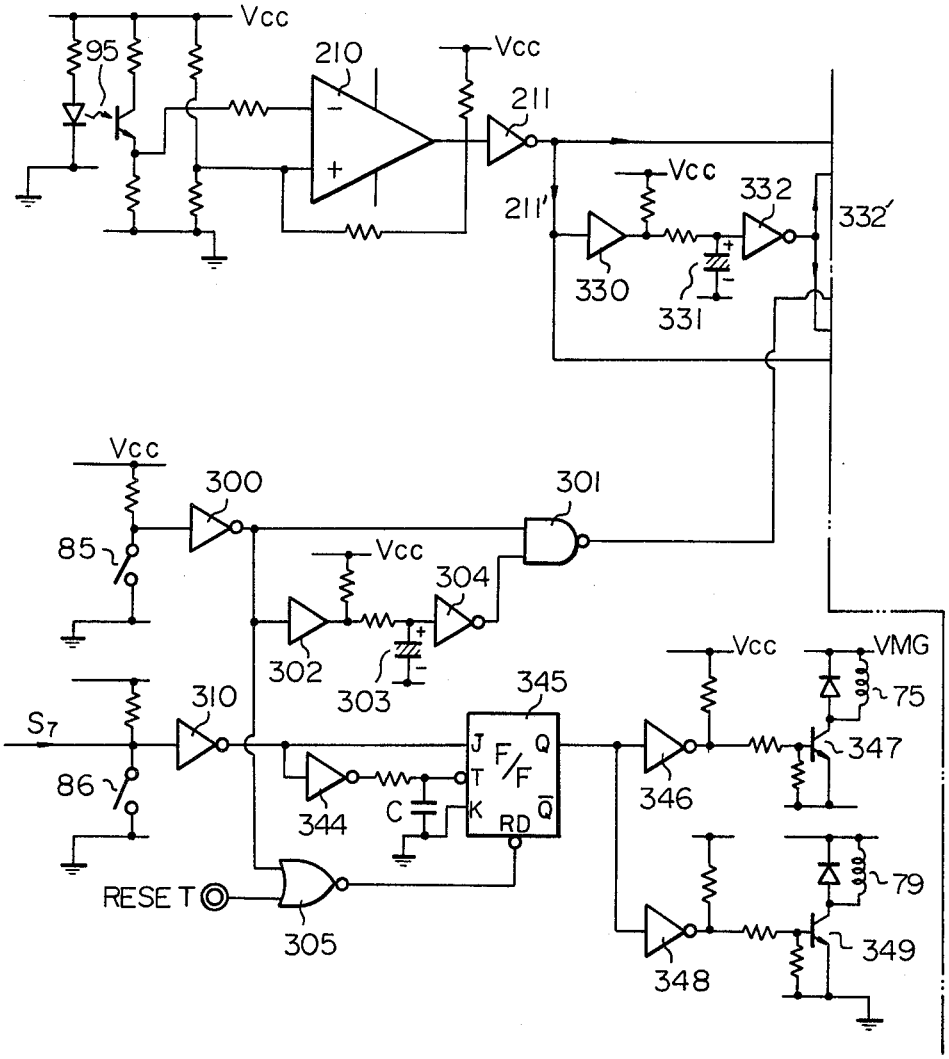
Figure 10B:
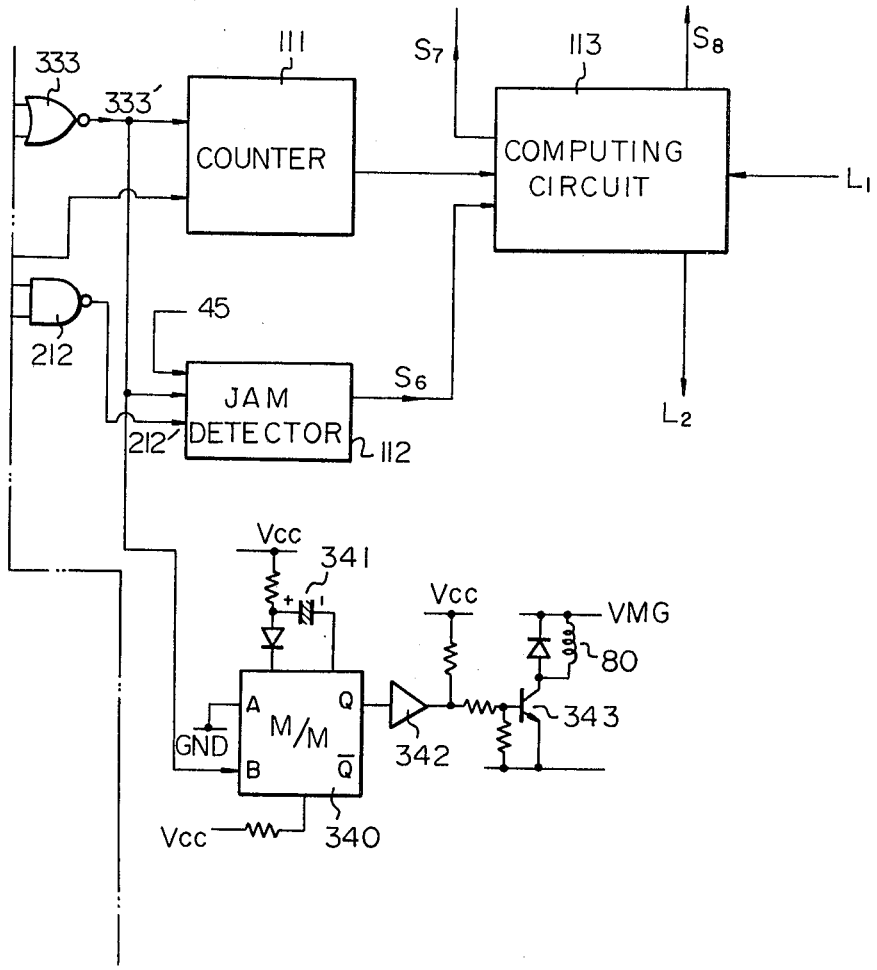
Figure 11:
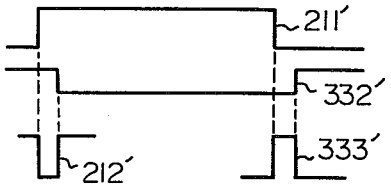
FIG. 11 is a timing chart showing the manner of detecting the leading and trailing ends of a sheet.

The circuit components 109–112 and 180 are shown in greater detail in FIGS. 10A and 10B. The reference numeral 95 in FIGS. 10A and 10B denotes a reflection type optical sensor of the sheet sensor 94 in the deflector section C. When the optical sensor 95 detects a copy sheet which passed through the deflector C into a bin E, a phototransistor becomes conductive so that the inverted input signal of an operational amplifier 210 becomes larger than the non-inverted input signal. Accordingly, the operational amplifier 210 produces an "L" level signal which is then inverted by an inverter 211 into a signal 211' whose waveform is shown in FIG. 11. This signal 211' is coupled to a NOR gate 333, an open collector buffer 330 and a NAND gate 212. The buffer 330 is followed by an RC delay circuit 331. After passing through the delay circuit 331, the output signal of the inverter 211 is slightly delayed and then inverted by an inverter 332 into a signal 332' shown in FIG. 11. This signal 332' is applied to the other input terminals of the NOR gate 333 and NAND gate 212. Consequently, as shown in FIG. 11, the NAND gate 212 produces a head-of-sheet detection signal 212' and the NOR gate 333 a tail-of-sheet detection signal 333' ($S_5$) each in the form of a pulse.

The output signal 212' of the NAND gate 212 triggers the jam detector circuit 112 and causes it to start the time $T_2+\delta$. As the copy sheet is safely discharged into the bin E, the NOR gate 333 delivers a signal 333' to the reset input terminal of the jam detector circuit 112. The circuit 112 is reset before the predetermined time expires and, therefore, the jam detection signal $S_6$ does not appear in this case. However, if the time period $T_2+\delta$ expires before the detection of the tail end of the copy sheet, the jam detector circuit 112 will not be reset and, thus, produce a jam detection signal $S_6$.

Meanwhile, the tail-of-sheet detection signal 333' from the NOR gate 333 is applied to the sheet discharge counter 111 and a monostable multivibrator circuit 340. Then the counter 111 counts up "1" while the monostable multivibrator 340 generates a pulse whose width is determined by an RC circuit 341. This output pulse is passed through an open collector buffer 342 and a transistor 343 to the solenoid 80 (FIG. 4) which is adapted to index the deflector C downward to the next bin E. As a result, the cam sleeve 82 makes a half turn to lower the deflector C by an incremental distance to the next bin E.

The next copy sheet will be discharged into the second bin E while being checked by the sheet sensor 94. The same procedures will be repeated to index the deflector C downward to the successive bins E.

Each time the deflector C moves downward to the following bin E, the comparator/computer 113 compares the count of the sheet discharge counter 111 with the designated number of copies N supplied thereto from a control circuit of the copying machine. When these two numerical values coincide with each other, the circuit 113 supplies the conveyance time generator 106 of the ADH control section with a document replacement signal $S_8$ and also supplies the copying machine 1 with a copy start enable signal $S_9$ through a copy start enable signal generating circuit 130. Additionally, the circuit 113 couples a deflector elevation signal $S_7$ to an inverter 310 of the solenoid drive 180.

When the deflector elevation signal $S_7$ appears or when the end switch 86 (FIG. 6) is closed after collation for all of the bins E has been completed, the deflector C will be returned to the position corresponding to the uppermost bin E in a manner described hereinbelow. When the end switch 86 is closed, the input of the inverter 310 becomes "L" and the inverted output of the inverter 310 is coupled to the J input terminal of a JK flip-flop 3 345 and an inverter 344. At this time, the direct reset input $\overline{RD}$ of the JK flip-flop 345 is "H" and the clock input $\overline{T}$ is also "H" due to the voltage of a capacitor C charged by the output of the inverter 344. Initially the flip-flop 345 remains reset by the K input connected to ground potential. However, receiving the J input, the flip-flop 345 is set when the T input becomes "L" and, thereupon, the Q output becomes "H". The output of this JK flip-flop 345 is supplied to open collector inverters 346 and 348. Then transistors 347 and 349 following the inverters 346 and 348 are turned off to, in turn, turn off the associated elevation solenoid 75 (FIG. 3) and electromagnetic clutch 79 (FIG. 4). Uncoupling of the clutch 79 makes the sprocket 73 free to rotate relative to the shaft 78 whereas de-energization of the solenoid 75 locks the sprocket 70 to the shaft 78, the deflector C thus starting its upward movement.

As the deflector C is elevated until it actuates the home position switch 85 (FIG. 6), the input level of an inverter 300 becomes "L". The inverted output of the inverter 300 is passed to a NAND gate 301, an open collector buffer 302 and a NOR gate 305. The output of the NOR gate 305 is coupled as a reset input $\overline{RD}$ to the JK flip-flop 345 which is then reset. This turns on the transistors 347 and 349 thereby energizing the solenoid 75 and electromagnetic clutch 79. The solenoid 75 releases the spring clutch 74 to fix the deflector C in the position aligned with the uppermost or the first bin E. The output of the buffer 302 on the other hand is slightly delayed by an RC delay circuit 303, inverted by an inverter 304 and coupled to the other input terminal of the NAND gate 301 so as to inhibit the same. Therefore, the NAND gate 301 produces a pulse having a given width when the home position switch 85 is closed. This output pulse of the NAND gate 301 resets the counter 111.

The initial conditions are restored in this way.

As has been discussed, it is not until the delivery of the final copy of a document of the same page into a bin E is confirmed that a document replacement signal $S_8$ appears.

Upon delivery of the signal $S_8$, the flip-flop 105 of the ADH control is set actuating the solenoid 39 which operates the stop pawl 39'. In response to the signal $S_8$, the conveyance time generator 106 produces a conveyance time signal $S_3$ so that, as already described, the electromagnetic clutch 37 is first coupled to start the rotation of the conveyor belt 38 and then the electromagnetic clutch 35 is coupled. Accordingly, the first document on the platen 4 is discharged by the conveyor belt 38 while the second document is transferred by the conveyor belt 38 onto the glass platen 4. The document discharge sensor 42 detects the first document discharged from the glass platen 4 and, when the tail-of-document detector or shaper 103 detects the trailing end of the first document, its output resets the flip-flop 105 through the OR gate 104. Then the solenoid 39 is turned off to stop the movement of the second document at the position of the stop pawl 39'.

Copies of the second document will be collated in the manner discussed in connection with the first document.

In the event jamming occurs in the collator 2, the apparatus will be operated as follws.

The jam detector 112 produces a jam detection signal $S_6$ when the sheet detector 94 in the deflector section D does not detect a sheet even after the lapse of time $T_1+\delta$ following the detection of a sheet at the sheet detector 45, or when the sheet detector 94 fails to detect the trailing end of a sheet after the lapse of time $T_2+\delta$ after it has detected the leading end of the sheet. The output $S_6$ of the jam detector 112 is supplied to the inlet guide plate driving solenoid circuit 147, clutch driving circuit 165 and comparator/computer 113. The circuit 165 uncouples the electromagnetic clutch 65 associated with the conveyor belt 64 of the collator 2. This stops rotation of every component part of the collator 2 except the inlet roller pair 46 and roller pair 49 for discharging copy sheets into the temporary discharge tray 50. Simultaneously, the solenoid 47 is energized to so position the associated guide plate 48 that all the sheets entering the collator 2 after the jamming has occured are directed to the temporary discharge tray 50.

Receiving the signal $S_6$, the comparator/computer 113 subtracts the count of the counter 111 from that of the counter 109 to determine the number n of jammed sheets and informs the copying machine 1 of the number n through the line $L_2$. As long as the collator 2 operates without jamming, the copying machine 1 keeps on delivering a cyclic series of copy sheets corresponding to the predetermined number N. In response to the input indicating the number n, the copying machine adds a number of copies equal to the jammed number n to the normal number N of copies. Therefore, the number of copy sheets fed to the tray 50 is the sum of the normal number N and the additional number n.

The copy sheets discharged into the tray 50 may be collated either by the manual insertion section F (FIG. 2) or by the feeder section B (FIG. 1).

Figure 9:
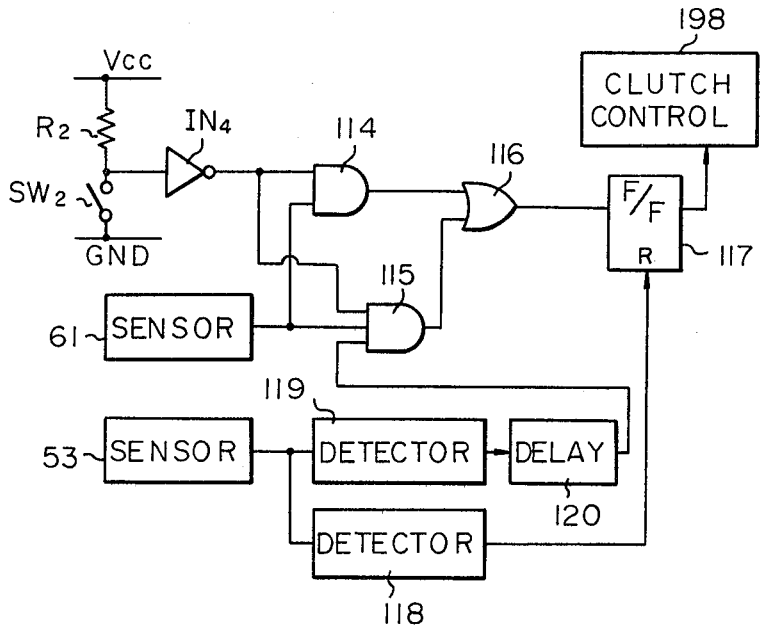
FIG. 9 is a block diagram of a control circuit associated with a feeder section of the collator.

A control circuit for the feeder section B is shown in FIG. 9. Sheets are loaded on the sheet feed table 60 and then a feed start switch $SW_2$ of this section is turned on. Since the sheet sensor 61 has delivered its output to an AND gate 114, an ON signal from an inverter $IN_4$ connected with the switch $SW_2$ is applied through the AND gate 114 and an OR gate 116 to a flip-flop 117. A set output of the flip-flop 117 activates a clutch control circuit 198. Then the clutch control circuit 198 couples an electromagnetic clutch 98 associated with sheet feed roller 96 as viewed in FIG. 1. The roller 96 cooperates with a stationary separating roller 97. The clutch 98 causes the roller 96 to rotate so that a copy sheet on top of the stack on the table 60 is fed. As this copy sheet reaches the intermediate roller pair 52, the sheet detector 53 senses it and couples its output to a head-of-sheet detector circuit 118 and a tail-of-sheet detector circuit 119, each designed in the same way as in the case of FIG. 10. A detection signal from the head-of-sheet detector 118 resets the flip-flop 117 whereupon the rotation of the feed roller 96 is interrupted. A detection signal from the tail-of-sheet detector 119 is delayed a given period of time by a delay circuit 120 and then passed through an AND gate 115 and the OR gate 116 to the flip-flop 117 which is again set.

In the event the flip-flop 117 is set, the feed roller 96 again starts to rotate and deliver the next copy sheet. When all of the copy sheets are fed out from the table 60 and the output of the sheet sensor 61 has disappeared, the outputs of the AND gates 114 and 115 become "0" to terminate the sheet supply by the feeder section B.

In this case, the deflector C initially remains in a position aligned with the same bin E as the one at the time of jamming. Thus, it will be successively indexed downward to the next bin E while collating the copy sheets supplied thereto from the feeder section B. When the counts of the sheet counters 109 and 111 coincide with each other, the comparator/computer 113 will deliver a document replacement signal $S_8$ as in the case of normal operation whereby the document on the glass platen will be replaced by another and the deflector C returned to the home position.

With the above procedure, collation at the time of jamming is completed whereupon the copying machine and collator carry out their operations which occur under normal conditions.

In summary, a copying machine according to the present invention permits an automatic document handling device ADH to be actuated for replacing a document only after a last one of a series of copies of the same page has been successfully stored in a bin. This reduces damage to documents and simplifies the structure of the device ADH. Additionally, the copying machine operates faster since a document is usually replaced by another while a deflector of a collator is returning back to its home position.

Means for making up for the lost number of sheets in the collator due to jamming have been shown and described as means which calculate the number n of jammed sheets, cause the copying machine 1 to continuously feed sheets with the number n compensated for, and allow the sheets in the temporary discharge tray 50 to be collated by manual insertion or through the feeder section F. This is not restrictive but only illustrative.

For instance, the comparator/computer 113 may include a gate circuit (not shown) and the copying machine 1 a copy counter CC. The arrangement is such that, in the event jamming has occurred, both the collator and the copying machine are made inoperative and the gate circuit of the circuit 113 is opened by a jam detection signal $S_6$ to pass the content of the counter 111 therethrough to the line $L_2$ instead of the number n of jammed sheets. The content (10 sheets for example) of the counter CC in the copying machine 1 is replaced by that of the counter 111 (8 sheets for example). As a result of the substitution, the count of the copy counter CC in the copying machine 1 naturally becomes smaller than the designated or set number N (15 for example). Hence, the copying machine 1 keeps on feeding sheets until its counter CC counts up to the designated number N. The temporary discharge tray 50 again receives the copies with the loss made up for; these copies can be collated by the feeder section B as in the first embodiment. The gate in the comparator/computer 113 will be closed by a sheet feed start enable signal $S_9$ which is to appear after the collation.

As described above, copy start may be enabled after it has been confirmed that the last one of a series of copy sheets of the same document has been delivered to a bin of a collator.

This involves the following drawback, however. A copying machine is operable not only in a collation mode and an assortment mode but in a usual copying mode in which delivery of copy sheets into bins does not occur; that is, a mode wherein copy sheets from a copying machine body are fed into a discharge tray. Typically, the usual copying mode is employed to make single copies or small numbers of copies of one or more documents. Accordingly, in the usual copying mode using a discharge tray, the number of copy sheets is relatively small and compensation for jamming is easier than in a collation mode. It will thus be understood that, in the usual copying mode, it is needless for the copying machine to enable the copy start only after a last one of a series of copy sheets of the same page has been confirmed as being stored in a bin of the collator. Rather, it is preferable to speed up the copying operation by enabling the next copying cycle when the number of copies produced (number of copy sheets of the same page) coincides with a preset number.

Figure 12:
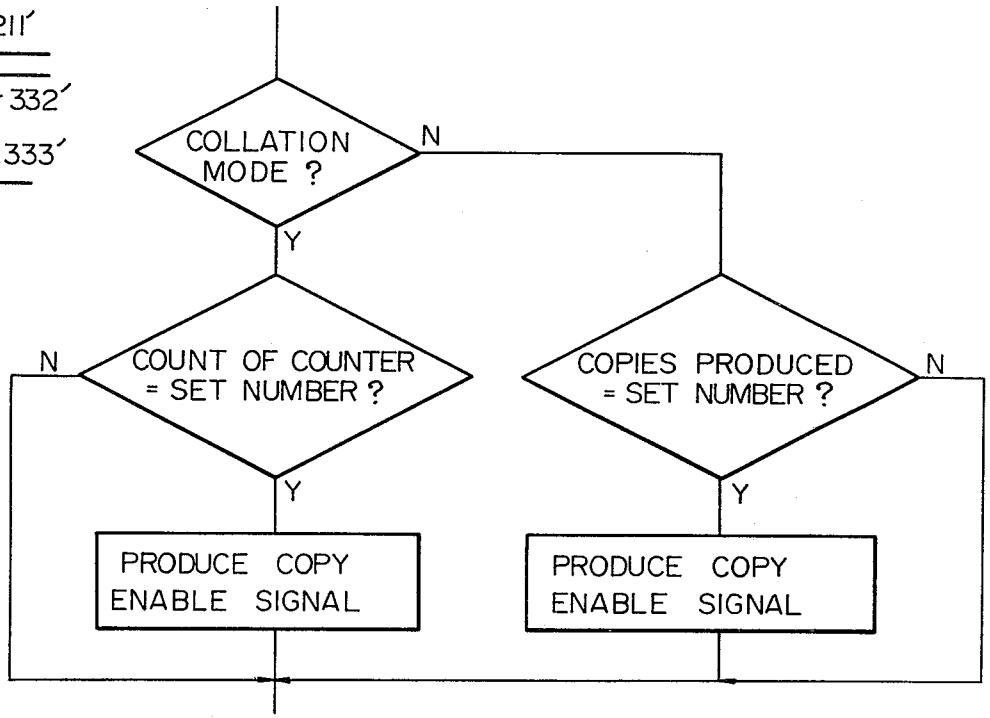
FIG. 12 is a flow chart demonstrating a part of the operation of a comparator/computer circuit included in the embodiment.

The comparator/computer circuit 113 may be supplied from a copy control section (not shown) of the copying machine 1 with a preset number N of sheets to be produced, the count of the copy counter CC and a mode signal. The copy control section enables a collation mode, assortment mode and usual copying mode selected through an input portion of the copying machine 1 and produces the mode signal corresponding to the selected mode. Also, the copy control section stores in a register the number of sheets N preset through the input portion and causes the sheet feed counter CC to count the number of copies produced. Controlled by the copy control section, the copying machine 1 has a print switch (not shown) turned on to start the copying operation and produces the preset number N of copy sheets. Meanwhile, the comparator/computer 113 identifies the selected mode in response to the mode signal. As shown in FIG. 12, if the selected mode is the collation mode, the circuit 113 will compare the count of the sheet discharge counter 111 with the preset number N and produce a deflector elevation signal $S_7$ and a document replacement signal $S_8$ when they coincide with each other. If either the assortment mode or the usual copying mode is selected, the circuit 113 will compare the count of the sheet feed counter CC with the preset number N and produce a document replacement signal $S_8$ when they coincide with each other. Furthermore, upon appearance of a jam detection signal $S_6$, the circuit 113 will subtract the content of the sheet discharge counter 111 from that of the sheet reception counter 109 to determine the number n of sheets to be lost by jamming (jammed number) and supply the copy control section with said number n. Here, the jammed number n means the number of sheets existing in the path between the sheet sensor 45 and discharge rollers 92 of the deflector C.

When the print switch of the copying machine 1 is depressed and the assortment mode is selected, copy sheets delivered from the copying machine 1 are discharged into a common bin E of the collator 2. The comparator/computer 113 identifying the assortment mode in response to a mode signal from the copy control section compares the sheet feed counter CC count from the copy control section with the preset sheet number N until they coincide, and keeps the deflector shifting circuit 180 deactivated. Accordingly, the deflector C remains stationary and copy sheets are fed into a common bin E. When the count of the counter CC coincides with the number N, the circuit 113 produces a document replacement signal $S_8$ and supplies a signal to the deflector shifting circuit 180 which then shifts the deflector C one bin downward by actuating the solenoid 80. Simultaneously, the circuit 113 couples a reset signal to the sheet discharge counter 111 and a copy start enable signal $S_9$ to the copy control section. The copying machine 1 in the case of jamming in the collator 2 will be operated in the same way as in the collation mode.

To operate the copying machine 1 in the usual copying mode, the collator 2 is disconnected from the copying machine body 1 and the print switch is depressed after mounting a discharge tray (not shown) on the sheet discharge portion of the copying machine body 1. Then the copy sheets will be fed into the discharge tray. In response to a mode signal, the circuit 113 identifies the usual copying mode and compares the sheet feed counter CC count with the preset number N. When these numbers coincide with each other, the circuit 113 delivers a copy start enable signal $S_9$ to the copy control section.

If desired, in the usual copying mode, the temporary discharge tray 50 of the collator 2 may be utilized to receive copy sheets from the copying machine 1. This is achievable merely by causing the computer/comparator 113 to supply signals to the solenoid 147 and clutch drive 165 so that the guide plate 48 is shifted to the phantom line position and the clutch 65 is uncoupled. In this situation, rotation of all of the rotary components is interrupted except the inlet roller pair 46 and discharge roller pair 49 directed to the tray 50 and, the copy sheets from the copying machine 1 are fed into the tray 50.

A copying machine according to this embodiment when in a collation mode permits the start of the next copying cycle in the event the content of a sheet discharge counter coincides with a preset number of sheets. This makes it possible to replace a document with another after the last one of a series of copy sheets of the same page has been surely delivered into a bin, minimizing the possibility of damage to documents and simplifying the structure of the ADH.

Various other modifications will become possible for those skilled in the art after receiving the teachings of the present disclosure without departing from the scope thereof.

What is claimed is:

1. A collating apparatus including a plurality of bins, deflector means for deflecting sheets into selected bins, feed means for feeding the sheets to the deflector means and discharge sensor means for sensing discharge of sheets from the deflector means into the bins, characterized by comprising:

sheet number storage means for storing a number representing the quantity of sheets to be collated;

discharge counter means for counting a number of sheets discharged into the bins;

comparator means for comparing the number of sheets discharged into the bins with the number of sheets to be collated and producing a next collating operation enable signal when said numbers are equal;

inlet sensor means for sensing entry of sheets into the feed means, inlet counter means for counting a number of sheets which entered the feed means, jam sensor means for sensing a sheet jam and producing a jam signal in response thereto; and a copying machine for copying a document and feeding the sheets in the form of copies of the document to the feed means, the copying machine comprising copy counter means for counting a number of copies produced, the apparatus further comprising means for directly transferring a count in the discharge counter means which represents the number of sheets discharged into the bins into the copy counter means to constitute a new count in the copy counter means in response to the jam signal.

2. An apparatus as in claim 1, in which the copying machine, in response to the enable signal, is enabled to copy a next document and feed copies thereof to the feed means for collation.

3. An apparatus as in claim 2, in which the copying machine comprises an automatic document handler for feeding the next document to a copying position in the copying machine in response to the enable signal.

4. An apparatus as in claim 1, further comprising a discharge tray and means for controlling the feed means to feed sheets into the discharge tray rather than to the deflector means in response to the jam signal.

5. An apparatus as in claim 1, in which the jam sensor means is constructed to produce the jam signal when the discharge sensor means does not sense a sheet within a predetermined length of time after the sheet is sensed by the inlet sensor means.

6. An apparatus as in claim 1, in which the jam sensor means is constructed to produce the jam signal when the discharge sensor means does not sense a trailing edge of a sheet within a predetermined length of time after sensing a leading edge of the sheet.

7. A collating apparatus including a plurality of bins, deflector means for deflecting sheets into selected bins, feed means for feeding the sheets to the deflector means and discharge sensor means for sensing discharge of sheets from the deflector means into the bins, characterized by comprising:

sheet number storage means for storing a number representing the quantity of sheets to be collated;

discharge counter means for counting a number of sheets discharged into the bins;

comparator means for comparing the number of sheets discharged into the bins with the number of sheets to be collated and producing a next collating operation enable signal when said numbers are equal;

inlet sensor means for sensing entry of sheets into the feed means, inlet counter means for counting a number of sheets which entered the feed means, jam sensor means for sensing a sheet jam and producing a jam signal in response thereto;

a copying machine for copying a document and feeding the sheets in the form of copies of the document to the feed means, the copying machine comprising copy counter means for counting a number of copies produced, the apparatus further comprising means for directly transferring a count in the discharge counter means which represents the number of sheets discharged into the bins into the copy counter means to constitute a new count in the copy counter means in response to the jam signal; and manual insertion means for allowing manual insertion of sheets into the feed means for collation.

* * * * *

UNITED STATES PATENT AND TRADEMARK OFFICE

CERTIFICATE OF CORRECTION

PATENT NO. : 4,449,813

DATED : May 22, 1984

INVENTOR(S) : Hideo Kikuchi et al.

It is certified that error appears in the above-identified patent and that said Letters Patent is hereby corrected as shown below:

On the title page, Item /75/ should be deleted to read as follows:

-- /75/ Inventors: Hideo Kikuchi, Tamaki Kaneko, Sunao Ikeda, Yohtaro Kakitani, Kunio Hibi and Tugio Okuzawa, all of Tokyo, Japan --.

Signed and Sealed this

*Thirteenth* Day of *November 1984*

[SEAL]

*Attest:*

GERALD J. MOSSINGHOFF

*Attesting Officer*

*Commissioner of Patents and Trademarks*